US008590297B2

(12) United States Patent
Kidd et al.

(10) Patent No.: US 8,590,297 B2
(45) Date of Patent: Nov. 26, 2013

(54) HYDRAULICALLY-POWERED COMPRESSOR

(75) Inventors: H. Allan Kidd, Shinglehouse, PA (US); William C. Maier, Almond, NY (US)

(73) Assignee: Dresser-Rand Company, Olean, NY (US)

( * ) Notice: Subject to any disclaimer, the term of this patent is extended or adjusted under 35 U.S.C. 154(b) by 172 days.

(21) Appl. No.: 13/106,077

(22) Filed: May 12, 2011

(65) Prior Publication Data

US 2011/0277456 A1 Nov. 17, 2011

Related U.S. Application Data

(60) Provisional application No. 61/334,393, filed on May 13, 2010.

(51) Int. Cl.
*F04D 13/04* (2006.01)

(52) U.S. Cl.
USPC ..... 60/453; 166/352; 166/357

(58) Field of Classification Search
USPC ..... 60/453; 166/351, 352, 357; 415/144
See application file for complete search history.

(56) References Cited

U.S. PATENT DOCUMENTS

| | | | | |
|---|---|---|---|---|
| 4,055,145 | A | 10/1977 | Mager | |
| 4,384,459 | A * | 5/1983 | Johnston | 60/641.7 |
| 4,848,471 | A * | 7/1989 | Bencze | 166/335 |
| 5,117,908 | A * | 6/1992 | Hofmann | 166/267 |
| 6,592,654 | B2 * | 7/2003 | Brown | 95/270 |
| 6,672,387 | B2 * | 1/2004 | Brady et al. | 166/266 |
| 6,907,933 | B2 * | 6/2005 | Choi et al. | 166/357 |
| 7,249,634 | B2 * | 7/2007 | de Albuquerque Lima Goncalves et al. | 166/335 |
| 7,594,543 | B2 * | 9/2009 | Goncalves et al. | 166/372 |
| 7,963,335 | B2 * | 6/2011 | Krehbiel et al. | 166/335 |
| 2003/0221827 | A1 * | 12/2003 | Brady et al. | 166/265 |
| 2005/0022552 | A1 * | 2/2005 | Lucas et al. | 62/613 |
| 2006/0151385 | A1 | 7/2006 | Burrows | |
| 2009/0152868 | A1 | 6/2009 | Beck | |
| 2009/0324391 | A1 * | 12/2009 | Maier | 415/121.2 |

FOREIGN PATENT DOCUMENTS

WO 2011143394 11/2011

OTHER PUBLICATIONS

International Application No. PCT/US2011/036208—Notification of International Search Report and Written Opinion mailed Jan. 12, 2012.

* cited by examiner

*Primary Examiner* — Thomas E Lazo
(74) *Attorney, Agent, or Firm* — Edmonds & Nolte, PC

(57) ABSTRACT

Apparatus and method for processing a process fluid at a remote location, with the apparatus including a pump located at a first location and configured to provide a pressurized working fluid. The apparatus also includes an umbilical coupled to the pump such that the umbilical receives the pressurized working fluid from the pump and transports the pressurized working fluid therefrom. The apparatus further includes a hydraulic turbine disposed at the remote location and coupled to the umbilical such that the hydraulic turbine receives the pressurized working fluid from the umbilical. The apparatus additionally includes one or more shaft energy conversion devices operatively coupled to the hydraulic turbine and disposed at the remote location.

21 Claims, 4 Drawing Sheets

HYDRAULICALLY-POWERED COMPRESSOR

BACKGROUND

This application claims priority to U.S. Patent Application Ser. No. 61/334,393, which was filed May 13, 2010. This priority application is hereby incorporated by reference in its entirety into the present application, to the extent that it is not inconsistent with the present application.

In subsea hydrocarbon production and transmission, it is possible to have a compressor system positioned in a remote location, i.e., subsea. These subsea compressor systems are generally powered by an electric motor connected to a centrifugal compressor that receives electrical power from a shore or platform-based electrical source. As such, the electrical power is supplied to the electric motor via an umbilical that extends from the electrical source to the remotely located compressor system. However, this configuration presents several challenges as the extended length of the umbilical leads to significant electrical line losses, e.g., up to two-thirds of the total power consumed in some cases. Furthermore, the large amount of power needed to power the high-speed motors that are often used in the compression field requires multiple and/or heavy gauge wires, thereby requiring a large diameter conduit, umbilical cord, or cable, which has a significant cost implication, i.e., millions of dollars per mile. Additionally, servicing or maintaining the electric motor and an accompanying electric switchgear becomes a significant challenge in remote installations, especially in hostile environments like subsea applications.

What is needed, therefore, is an efficient apparatus and method for compressing gas at a remote location, including subsea locations, that does not suffer from these and other drawbacks inherent in conventional systems.

SUMMARY

Embodiments of the disclosure may provide an exemplary apparatus for processing a process fluid at a remote location. The exemplary apparatus may include a pump, an umbilical, a hydraulic turbine and one or more shaft energy conversion devices. The pump may be located at a first location and configured to provide a pressurized working fluid. The umbilical, which may be a pipe or any other type of conduit, may be coupled to the pump such that the umbilical receives the pressurized working fluid from the pump and transports the pressurized working fluid therefrom. The hydraulic turbine may be disposed at the remote location and coupled to the umbilical such that the hydraulic turbine receives the pressurized working fluid from the umbilical. The one or more shaft energy conversion devices may be operatively coupled to the hydraulic turbine and disposed at the remote location.

Embodiments of the disclosure may further provide an exemplary method for compressing a process fluid at a remote location. The exemplary method may include pressurizing a working fluid at a first location to provide a pressurized working fluid and transporting the pressurized working fluid to the remote location. The exemplary method may also include receiving the pressurized working fluid with a hydraulic turbine located at the remote location and powering a compressor with the hydraulic turbine. The exemplary method may further include compressing the process fluid with the compressor.

Embodiments of the disclosure may further provide an exemplary hydraulically-powered compression apparatus. The exemplary apparatus may include a driver, a pump, an umbilical, a hydraulic turbine, and a compressor. The driver may include at least one of an electrical motor, a gas turbine, a gas engine, a diesel engine, an expander, and a steam turbine. The pump may be operatively coupled to the driver and located on land, on a ship or boat, or on a platform disposed above or floating on the water. Further, the pump may have an intake configured receive a hydraulic fluid, and an outlet, with the pump configured to provide pressurized hydraulic fluid to the outlet. The umbilical may be coupled to the outlet of the pump and may extend from the pump substantially to a sea floor, with the umbilical receiving and transporting the pressurized hydraulic fluid from the pump. The hydraulic turbine may be located proximal the sea floor and operatively coupled to a shaft. The hydraulic turbine may include blades coupled to the shaft, an inlet coupled to the umbilical, an outlet communicating with an ambient environment proximal the sea floor or returned to the hydraulic fluid pumping system, and a bypass control valve including a flow control block that is slidable between a first position in which the flow control block directs substantially all of the pressurized hydraulic fluid, to a bypass flow port and a second position in which the flow control block directs substantially all of the pressurized hydraulic fluid to the blades. The compressor may be operatively coupled to the shaft and located proximal the sea floor, and may compresses a process fluid.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
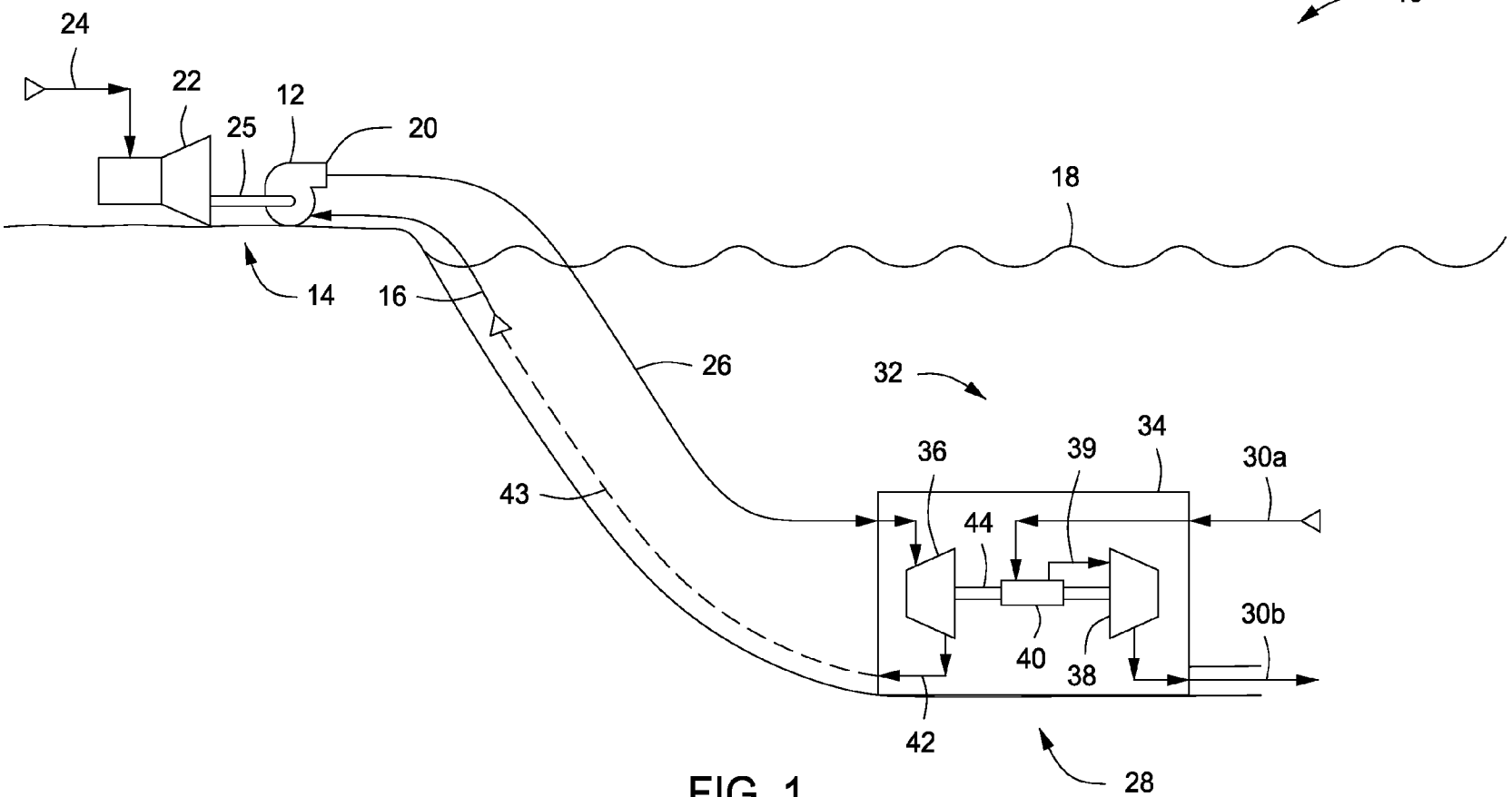
FIG. 1 illustrates a schematic view of an exemplary compression system, according to one or more aspects of the disclosure.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates a schematic view of an exemplary compression system 10, according to one or more embodiments described. The compression system 10 includes a pump 12, which is positioned at a first location 14. The first location 14 can be any location that is relatively easy to access. For example, the first location 14 may be on land, as shown, but in various other embodiments, may be on a vessel such as a ship, boat, or platform. The pump 12 may be any suitable pump known in the art, for example, a bilge turbopump of the type commercially-available from AWG of Germany. The pump 12 can include an intake line 16 that is configured to bring a working fluid into the pump 12. In an exemplary embodiment, the intake line 16 can be partially submerged in a body of water 18, which may be, for example, an ocean, sea, or lake. The pump 12 may further include an outlet 20 connected to an umbilical 26.

The umbilical 26 generally represents a pipe, tube, or any other type of conduit configured to contain and transmit a high-pressure hydraulic fluid, such as sea water, therethrough. The umbilical 26 can be sized to supply sufficient fluid pressure and volume generated by the pump 12 to the remote assembly 32, as further described herein. One significant advantage the umbilical 26 of the present disclosure provides is that the umbilical 26 costs a small fraction of the cost of a conventional electrical conduit (umbilical) configured to provide power to a similar remote assembly 32 (i.e., one driven by an electric motor).

The pump 12 may be chosen such that near-peak or peak efficiency thereof is realized during normal intended operation of the compression system 10. To support such intended operation, the pump 12 may be configured to provide working fluid through the outlet 20 at from about 3,000 gallons per minute (gpm), about 3,250 gpm, or about 3,500 gpm up to about 4,000 gpm, about 4,500 gpm, about 5,000 gpm, or more as required by the compression system 10. Further, the pump 12 may be configured to provide a pressure in the working fluid at the outlet 20 of from about 500 psi, about 1,500 psi, or about 2,500 psi up to about 3,000 psi, about 4,000 psi, about 5,000 psi, or more as required by the compression system 10.

The pump 12 may be driven by a driver 22, which may be a gas turbine that is fed by natural gas, or any other suitable fluid, via line 24. Alternatively or additionally, the driver 22 may be or include a diesel engine, a gas engine, an expander, and/or a steam turbine. The driver 22 may be configured in any suitable arrangement for driving or otherwise powering the pump 12. For example, the driver 22 may be coupled to a shaft 25 that extends to the pump 12, as shown, such that the driver 22 causes the shaft 25 to be rotated and thereby drive the pump 12. In various other exemplary embodiments, the pump 12 may include an electric motor (not shown), and the driver 22 may be coupled to a generator (not shown) such that the generator converts shaft rotation from the driver 22 to electrical energy, which the electric motor uses to drive the pump 12. In still other exemplary embodiments, the pump 12 may be coupled to a civil electricity grid (not shown) to provide power to drive the pump 12. Furthermore, various exemplary pumps 12 may be connected to more than one source of power, such as any of those described and/or others, to provide redundancy in powering the pump 12. In other embodiments, the pump 12 may be driven by a combination of the illustrated driver 22 and an electric motor (not shown), with the electric motor being used to supplement power to the pump 12 when needed, and also to generate/supply electrical power back to the electric grid or another machine in situations where the full power of the driver 22 is not being used to drive the pump 12.

The outlet 20 of the pump 12 may be connected to the umbilical 26 via any suitable pipe connection method and/or device. The umbilical 26 may be a substantially blank pipe, or may be multiple pipes threaded, soldered, welded, or otherwise connected together so that the umbilical 26 may extend from the pump 12 to the remote assembly 32. Further, the umbilical 26 may be constructed of a rigid or flexible material and may have a thickness such that the umbilical 26 can transport the working fluid therethrough at the pressures required to operate a remote assembly 32 of the compression system 10, which will be described in greater detail below. Thus, the umbilical 26 is generally configured to extend and communicate pressurized fluid from the first location 14 to the second or "remote" location 28. In various exemplary embodiments, the umbilical 26 may extend a length of from about 5000 feet, about 10,000 feet, about 15,000 feet, about 17,500 feet, or about 20,000 feet to about 27,500 feet, about 30,000 feet, about 32,500 feet, or more. In various exemplary embodiments, the umbilical 26 may have an inside diameter of from about 4 inches, about 6 inches, about 8 inches, about 10 inches, or about 12 inches to about 14 inches, about 16 inches, about 18 inches, or more.

The remote location 28 may be any location that is separated from the first location 14, but is not necessarily limited to a location that is inconvenient or difficult to reach. In some exemplary embodiments, however, the remote location 28 may indeed be a location to which it is difficult and/or expensive to transport electrical energy. For example, the remote location 28 may be at the bottom of the body of water 18, i.e., subsea, as shown in FIG. 1. Further, the remote location 28 may be on the ocean floor proximal two sections of a transmission line (i.e., an upstream section 30*a* and a downstream section 30*b*). In an exemplary embodiment, the upstream section 30*a* of the transmission line may be connected to production equipment in a hydrocarbon well (not shown).

The remote assembly 32 is located at the remote location 28 and may include one or more liquid-tight casings 34, in which a hydraulic turbine 36 may be disposed. The remote assembly 32 may also include one or more fluid processing devices, such as rotating shaft energy conversion devices. In an exemplary embodiment, such fluid processing devices may include a compressor 38 and/or a separator 40. It will be appreciated, however, that other fluid processing devices may also be included or substituted according to this disclosure. The one or more fluid processing devices may be disposed in the same casing 34 as the hydraulic turbine 36, as shown; however, in other exemplary embodiments, one or more of the fluid processing devices may be in one or more other or separate casings or enclosures (not shown) as required by the specific implementation.

The hydraulic turbine 36 is coupled to the umbilical 26, for example, through the casing 34, using any manifolds, ducts, valves, or the like, as may be necessary, such that the hydraulic turbine 36 receives the pressurized working fluid from the umbilical 26 and converts the pressure in the working fluid in to rotating motion that may be used to drive the rotating equipment in the casing 34. Further, the hydraulic turbine 36 includes a discharge line 42, through which the hydraulic turbine 36 discharges de-pressurized working fluid. In an exemplary embodiment, the discharge line 42 may fluidly communicate with the ambient (e.g., underwater) environment of the remote location 28. In such open-loop embodiments, the working fluid may be discharged into the ambient environment at a pressure that is higher than the ambient pressure. Accordingly, the working fluid may be seawater, to avoid contamination of the ambient environment.

In other embodiments, the discharge line 42 may be connected with the intake line 16 of the pump 12 via line 43, shown as dashed in FIG. 1, such that the de-pressurized working fluid is re-pressurized in the pump 12. As such, the compression system 10 may be characterized as being closed-loop, but may also provide structures and connections for adding fresh working fluid as needed, for example, to make up for any process fluid that leaks across an seals. The closed-loop embodiments of the compression system 10 may permit the use of numerous types of hydraulic fluid such as glycol, which may generally be unsuitable in open-loop embodiments in which the working fluid is discharged into the ambient environment. In some embodiments, however, the hydraulic fluid in the closed loop system may be fresh water or seawater.

The hydraulic turbine 36 is coupled to a shaft 44 and imparts rotation thereto as a result of the reduction in pressure of the working fluid. The rotating shaft 44 may be coupled to the separator 40 and the compressor 38, as shown; however, in various exemplary embodiments, additional fluid processing devices may be interposed between any of the hydraulic turbine 36, the separator 40, and the compressor 38. It will be appreciated that the remote assembly 32 need not include both a compressor 38 and a separator 40, however, and one may be omitted without departing from the scope of this disclosure.

Furthermore, the shaft 44 may include multiple rotors which may be coupled together, for example, by a gear box, a flexible coupling, or another shaft-coupling device (none shown). Moreover, although not shown, the shaft 44 may instead or additionally be coupled to a generator, which in turn is electrically coupled to an electric motor for driving the compressor 38, separator 40, and/or any other fluid processing devices. Other similar hydraulically-powered remote assemblies 32 for fluid processing will be apparent according to this disclosure. In various exemplary embodiments, the hydraulic turbine 36 may be configured to supply from about 500 hp, 4,000 hp, about 5,000 hp, or about 6000 hp to about 7,000 hp, about 15,000 hp, or about 30,000 hp to the shaft 44.

In an exemplary embodiment, the separator 40 is coupled to the upstream section 30*a* of the transmission line. The separator 40 may be a rotary separator, which may include, for example, a driven rotatable drum or an IRIS® -type separation apparatus, commercially available from Dresser-Rand Co., Olean, N.Y., USA, which converts line pressure into rotation to affect separation. In driven embodiments, the separator 40 may be coupled to the compressor 38 and the hydraulic turbine 36 via the shaft 44. The separator 40 may be close-coupled to the compressor 38, such that the drum of the separator 40 is directly adjacent an impeller (not shown) of the compressor 38 for concomitant rotation. An example of a separator close-coupled to a compressor is provided in U.S. patent application having Ser. No. 12/441,804, which is incorporated herein by reference in its entirety to the extent consistent with the present disclosure. Furthermore, the separator 40 may be fluidically coupled to the compressor 38 via line 39; however, it will be appreciated that in embodiments having the separator 40 close-coupled to the compressor 38, the line 39 may be internal to the separator 40 and/or compressor 38. In other embodiments, the separator 40 may not be coupled to the shaft 44, but may instead be or include a stationary separator, such as filter, baffle, separating turn, slug catcher, sedimentation tank, or any other such stationary separator known in the art. In such cases, the hydraulic turbine 36 may directly drive the compressor 38. Moreover, the separator 40 may include a combination of stationary and rotary elements.

Figure 2:
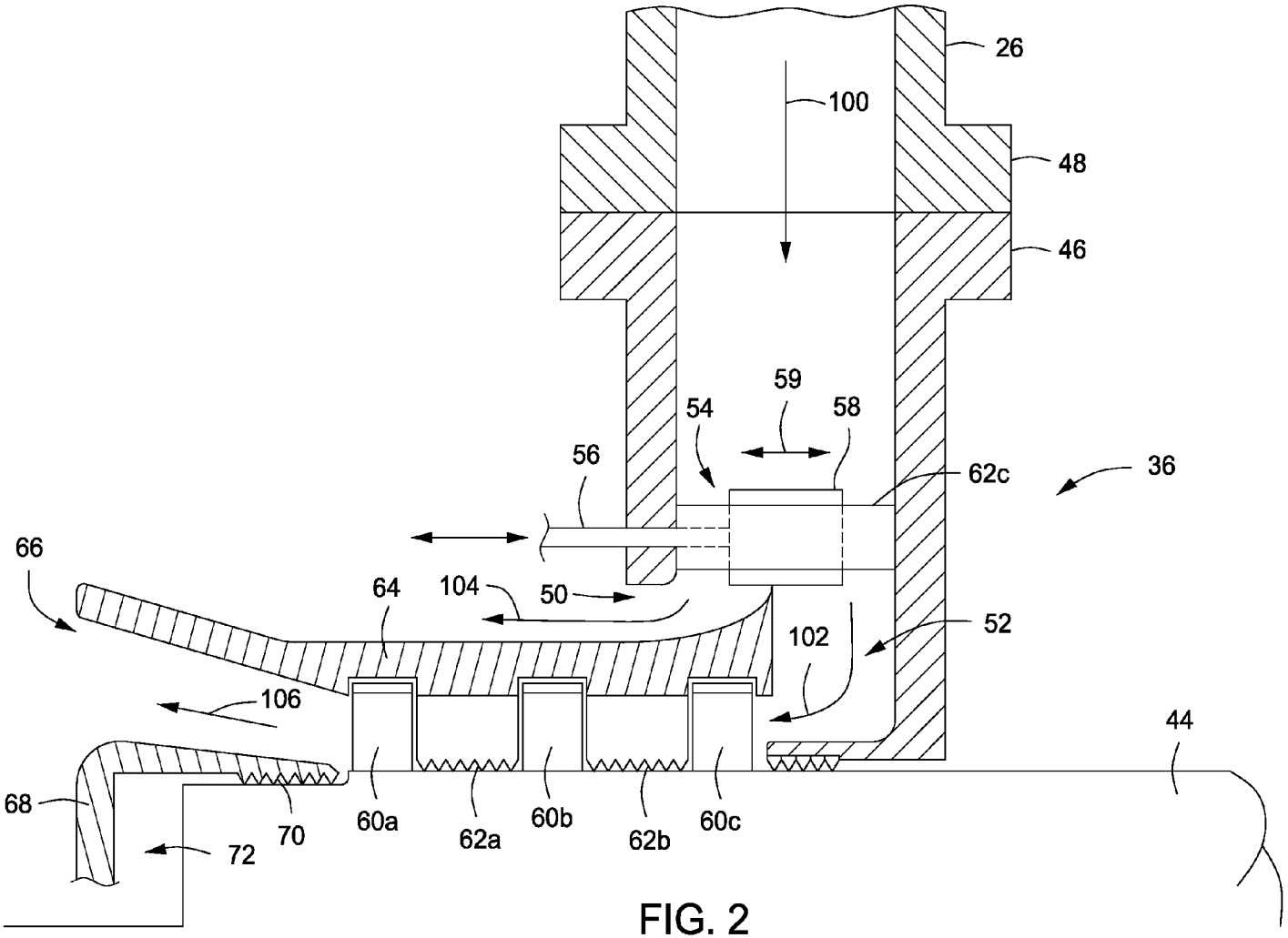
FIG. 2 illustrates a partial, cross-sectional view of an exemplary hydraulic turbine, according to one or more aspects of the disclosure.

FIG. 2 illustrates a simplified cross-sectional view of the hydraulic turbine 36, according to an exemplary embodiment. As described above with reference to FIG. 1, the hydraulic turbine 36 is coupled to the umbilical 26, and may be directly coupled thereto, or may include any necessary manifolds, ducts, valves, etc. positioned therebetween to facilitate fluid handling. Accordingly, flanges 46, 48 may be fixed to the hydraulic turbine 36 and to the umbilical 26, respectively. The flanges 46, 48 may be welded, fastened, or otherwise fixed together to provide a linkage between the umbilical 26 and the hydraulic turbine 36. The pressurized working fluid may flow through the umbilical 26 and into the hydraulic turbine 36, as shown at 100.

In an exemplary embodiment, the hydraulic turbine 36 includes a bypass flow port 50 and a turbine flow passage 52. Both the bypass flow port 50 and the turbine flow passage 52 may fluidly communicate with the umbilical 26, with the extent of the fluid communication controlled by an actuating bypass control valve 54. The bypass control valve 54 may include an actuator 56 and a flow control block 58. In various exemplary embodiments, the actuator 56 may be an electronically-controlled solenoid and/or may include a mechanical linkage to, for example, a servomotor or the like. Further, the actuator 56 may be attached to a control system (not shown), which may include sensors configured to determine pressure in the umbilical 26 and/or the load on, pressure in, or other operating conditions of the hydraulic turbine 36. Although not shown, the actuator 56 may instead or additionally be manually controlled via electronic or mechanical connection to a control station where an operator can control the actuator 56.

The flow control block 58 may be movable as shown by arrow 59, for example, slidable by the actuator 56 between a full-open position and a full-closed position, and may be maintained at any number of positions therebetween. In the full-open position, the flow control block 58 may be pulled to the left, such that the flow control block 58 substantially avoids obstructing the turbine flow passage 52. In the full-closed position, the flow control block 58 may substantially obstruct the turbine flow passage 52, reducing the flow of pressurized working fluid thereto, while increasing the pressurized working fluid flow to the bypass flow port 50.

Applicants note that terms such as "left," "right," "up," "down," "above," or the like are used herein merely for convenience in describing the Figures. As such, the use of these and similar directional terms is intended to refer merely to the relative positions of the various described components and is not to be considered an absolute direction. Indeed, one with skill in the art will appreciate that the directions described herein can be reversed or changed by reversing or changing the orientation of the described components, or by changing the perspective from which they are viewed, without departing from the scope of this disclosure.

Referring again to FIG. 2, the hydraulic turbine 36 may further include a plurality of rotor blades (three are shown: 60*a-c*) and stator vanes (three are shown: 62*a-c*), which may be, for example, disposed in alternating sequence. It will be appreciated, however, that any sequence and/or number of rotor blades 60*a-c* and stator vanes 62*a-c* may be used to optimize power transfer to the shaft 44 without departing from the scope of this disclosure. The stator vanes 62*a-c* may be coupled to a stationary housing 64 of the hydraulic turbine 36, while the rotor blades 60*a-c* are coupled to the shaft 44. Further, the rotor blades 60*a-c* may be fabricated (e.g., cast, milled, forged, or the like) separately from the shaft 44, or may be cut directly into the shaft 44 using, for example, three or more axis milling machines and techniques, or the like.

The stator vanes 62*c* may be referred to as first stage stator vanes 62*c* and may be oriented to achieve a radial inflow flowpath arrangement. In an exemplary embodiment, the first stage stator vanes 62*c* and may be of a two-dimensional prismatic extrusion shape. In such an exemplary embodiment, the cross-sectional shape of the first stage stator vanes 62*c* may be similar to or the same as a traditional turbine stator airfoil shape of any suitable section modulus. In an exemplary embodiment, the flow control block 58 may be slidably mounted between the first stage stator vanes 62*c* and the umbilical 16 and may surround the first stage stator vanes 62*c*, as shown.

The hydraulic turbine 36 may also include a diffuser channel 66, which may be coupled to the discharge line 42 (FIG. 1). In an exemplary embodiment, the diffuser channel 66 may be configured to maximize the amount of energy available for extraction by the hydraulic turbine 36. Additionally, the hydraulic turbine 36 may be "overhung," as shown, such that the hydraulic turbine 36 does not include additional bearings on the downstream (e.g., left, as shown) side of the rotor 60*a* most proximal the diffuser channel 66. In other embodiments, however, the hydraulic turbine 36 may be disposed on the shaft 44, between two journal bearings. However, since the pressure of the working fluid 52 is greater proximal the rotor blade 60*c* than in the diffuser channel 66, a net force, due to the pressure differential, may apply an axial load on the shaft 44, for example, from left to right, as shown. To compensate, the hydraulic turbine 36 may include a thrust balancing chamber 72 defined between an inner housing portion 68 and an end of the shaft 44. In an exemplary embodiment, as shown, the inner housing portion 68 may be stationary relative to the rotating shaft 44 and sealed therewith using any suitable shaft seal 70. In such an exemplary embodiment, a feed of high-pressure fluid may be introduced to the thrust balancing chamber 72, thereby providing a counter-thrust to compensate for aforementioned pressure differential. In various exemplary embodiments, the high-pressure fluid introduced to the thrust balancing chamber 72 may be or include the pressurized working fluid from the umbilical 26, which may be, for example, filtered and/or otherwise purified, or may be another high-pressure fluid. In another exemplary embodiment, although not shown, one or more thrust balancing pistons, e.g., discs stationarily or rotatably disposed around the shaft 44, may be provided to compensate for the thrust in lieu of or in addition to the thrust balancing chamber 72. Further, although not shown, in an exemplary embodiment, the hydraulic turbine 36 may include a second set of rotors and stators (not shown) extending along the shaft 44 to the right (as shown), generally configured as a mirror image to the rotor blades 60*a-c* and stator vanes 62*a-c* to provide a back-to-back turbine assembly, which may provide for a more balanced axial thrust along the shaft 44. Moreover, various other axial pressure compensating devices, such as bearings, pistons, collars, etc., are known in the art, and any may be included without departing from the scope of this disclosure.

Figure 3:
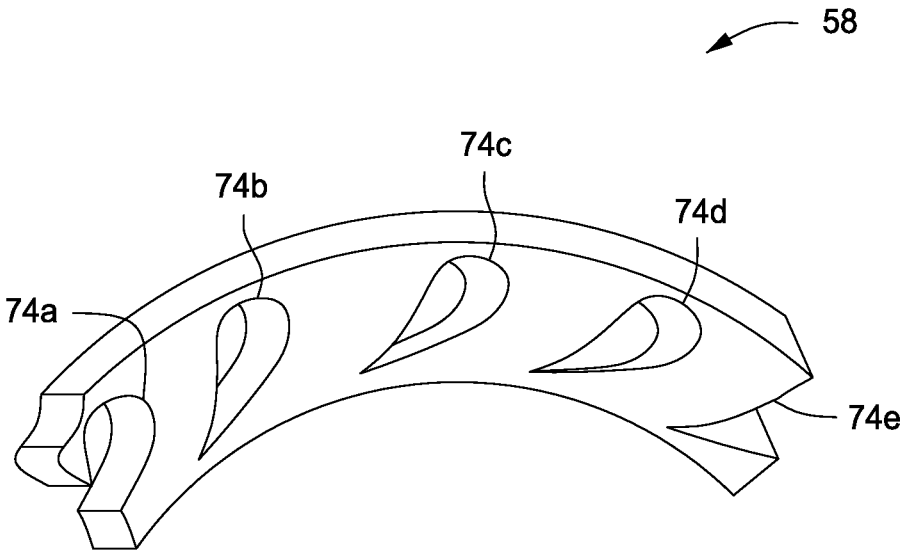
FIG. 3 illustrates a broken-away, perspective view of an exemplary flow control block, according to one or more aspects of the disclosure.

With continuing reference to FIG. 2, FIG. 3 illustrates a broken-away perspective view of a portion of the flow control block 58. As shown, the flow control block 58 may be generally arcuate in shape and may be annular. Accordingly, the flow control block 58 may encircle the shaft 44, or may extend partially around the shaft 44, extending arcuately between shoulders, grooves, tracks, or the like (not shown) disposed on or defined in the hydraulic turbine 36. In other exemplary embodiments, the flow control block 58 may be a flat plate, may be rectangular and circumscribe the shaft 44, or may be any other suitable geometry. Further, the flow control block 58 may include a plurality of apertures or cutouts (five are shown: 74*a-e*) defined therein, which may extend radially therethrough. The apertures 74*a-e* may be airfoil shaped, as shown, may be simple rectangular slots, or may be any other shape. Moreover, the apertures 74 may be matching and/or axially-aligned. In other exemplary embodiments, the apertures 74*a-e* may be omitted.

In exemplary embodiments in which the apertures 74*a-e* are included and are airfoil shaped, as the flow control block 58 is moved by the actuator 56 along the housing 64, the increase in the area of the apertures 74*a-e* aligned with the bypass flow port 50 increases non-linearly (e.g., exponentially) as the flow control block 58 is moved toward the left. Similarly, the increase in the area of the apertures 74*a-e* aligned with the turbine flow passage 52 increases non-linearly (e.g., inversely exponential) as the flow control block 58 is moved toward the right. This configuration may provide a quick response for control of turbine speed and power without serious risk of deleterious "water-hammer" effects due to the large momentum of the motive fluid in the umbilical 16.

Referring again to FIG. 1, in exemplary operation of the compression system 10, the working fluid, for example, water from the body of water 18, is received via intake line 16 into the pump 12, which is powered by a driver such as the turbine 22. The pump 12 pressurizes the working fluid to provide pressurized working fluid into the umbilical 26. The pressurized working fluid traverses the umbilical 26 and is received by the hydraulic turbine 36.

Referring again to FIG. 2, the working fluid is received from the umbilical 26 by the hydraulic turbine 36, as illustrated by arrow 100. Generally, a portion of the pressurized working fluid is introduced to the turbine flow passage 52, and a portion is introduced to the bypass flow port 50. The relative portions are controlled by the bypass control valve 54, which, as described above, may be actuated in a generally axial direction, as shown by arrow 59. For example, when the bypass control valve 54 is in the full-open position (e.g., the flow control block 58 is aligned with the bypass flow port 50), the turbine flow passage 52 is substantially unobstructed, and thus receives the maximum amount of the pressurized working fluid along arrow 102. In the full-open position, the turbine flow passage 52 may receive at least a majority of the pressurized working fluid, for example, substantially all of the pressurized working fluid. In various exemplary embodiments, including those in which the flow control block 58 includes apertures 74*a-e* (FIG. 3), at least some of the pressurized working fluid may still flow through the bypass flow port 50, as shown by arrow 104, even when the bypass control valve 54 is in the full-open position.

When the bypass control valve 54 is in the full-closed position (e.g., the flow control block 58 is aligned with the turbine flow passage 52), the turbine flow passage 52 may be substantially obstructed by the flow control block 58, with at least a majority, for example, substantially all, of the pressurized working fluid being directed through the bypass flow port 50, as shown by arrow 104. The provision for working fluid continuing into the turbine flow passage 52 even when the bypass control valve 54 is in the full-closed position is for safety and protection of the equipment train and/or other purposes that will readily be appreciated by one with skill in the art. In an exemplary embodiment, the bypass control valve 54 may be supplemented by one or more additional flow control valves (not shown), which may be located proximal to either the hydraulic turbine 36 or the pump 12. Such additional flow control valves may be slower acting to limit transient "water-hammer" issues, but may regulate the total flow in the umbilical 16 so that the amount of motive fluid being bypassed is minimized.

Furthermore, it will be appreciated that the flow control block 58 may be maintained at any number of intermediate positions between the full-open and closed throttle positions, such as the intermediate position shown in FIG. 2. This may allow for quick and flexible adjustment of the operating speed and power output of the hydraulic turbine 36, accounting for any dynamic or changed load conditions as applied by the fluid processing equipment.

The pressurized working fluid via the turbine flow passage 52 may proceed as shown by arrow 102 to the rotor blades 60*a-c* and stator vanes 62*a-c*, such that the potential energy stored in the high pressure of the pressurized working fluid is exchanged for rotation of the shaft 44. Accordingly, the depressurized working fluid may exit the hydraulic turbine 36 via the diffuser 66 as shown by arrow 106.

Referring again to FIG. 1, the hydraulic turbine 36 may thus provide power to the separator 40, the compressor 38, or any other fluid processing devices disposed at the remote location 28. Accordingly, the separator 40 may receive a process fluid from the upstream section of the transmission line 30*a* and may remove a high-density component, such as liquid, therefrom, which may be directed to additional fluid processing equipment such as a process fluid pump (not shown), may bypass the compressor 38 and be reintroduced to the downstream section of the transmission line 30*b*, or may be otherwise collected or discharged from the compression system 10. The remaining low-density portion of the process fluid may be directed to the compressor 38, which may compress the process fluid, and provide the compressed process fluid to the downstream section of the transmission line 30*b*.

Figure 4:
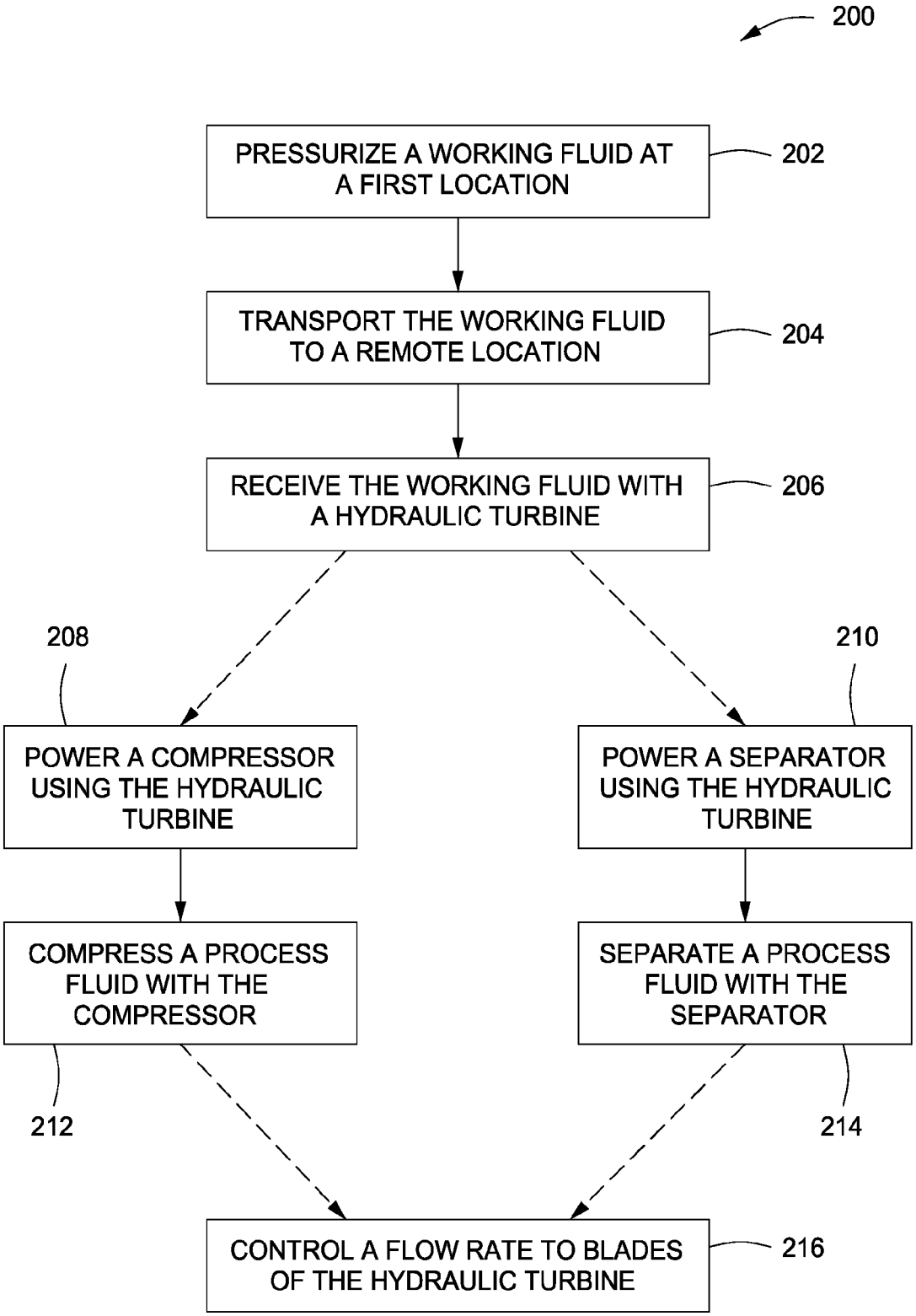
FIG. 4 illustrates a flowchart of an exemplary method for remote compression, according to one or more aspects of the disclosure.

FIG. 4 illustrates a flow chart of an exemplary method 200 for compressing a process fluid at a remote location. The method 200 may begin by pressurizing a working fluid at a first location, as at 202. The first location may be a relatively convenient location, such as on land, on a vessel such as a ship, on an oil platform, or the like. The method 200 may proceed to transporting the pressurized working fluid to the remote location, as at 204. The remote location may be the ocean floor, for example. The method 200 may also include receiving the working fluid with a hydraulic turbine. The hydraulic turbine may include a plurality of stages to account for dynamic and/or high loading, to provide optimum efficiency at desired operating conditions.

The method 200 may also include powering a compressor with the hydraulic turbine, as at 208, powering a separator using the hydraulic turbine, as at 210, or both. Furthermore, the separator and the compressor may be located on a common shaft, or on different shafts, and/or may be close-coupled together, as described above with reference to FIG. 1. In embodiments including powering the compressor, as at 208, the method 200 may include compressing a process fluid with the compressor, as at 212. The process fluid may be any fluid such as natural gas in a subsea transmission line, to name just one example among many possible. Additionally or instead, in exemplary embodiments including powering the separator as at 210, the method 200 may include separating the process fluid with the separator, as at 214. The separator may be a rotary separator, or the like, which may be operable to separate high-density components, such as liquids, from low-density components, such as gases. In an exemplary embodiment, this may be done so that the gas can be compressed in one or more centrifugal compressors, through which it may be generally undesirable to run liquids and/or other high-density process fluid components.

The method 200 may also include controlling a flow rate of the pressurized working fluid to rotor blades of the hydraulic turbine, as at 216. Such controlling may include diverting a portion of the pressurized working fluid through a bypass flow port, to avoid damaging any tubing extending between the pump and the hydraulic turbine due to pressure back-ups. Further, such controlling may allow optimizing a flow rate to blades of the hydraulic turbine in response to compressor and/or separator load, and may allow for such control with a quicker response time than is typically possible by simply reducing power to the pump at the first location. Accordingly, this may avoid damaging an umbilical extending from the pump to the hydraulic turbine due to back up in pressure. Furthermore, controlling the flow rate at 216 may include actuating the bypass control valve by sliding a flow control block between a full-open position, in which substantially all of the working fluid is directed through a turbine flow passage and received by the blades of the hydraulic turbine, and a minimum-throttle position, in which substantially all of the working fluid is directed through the bypass port.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. An apparatus for processing a process fluid at a remote location, comprising:

a pump located at a first location, the pump configured to provide a pressurized working fluid;

an umbilical coupled to the pump such that the umbilical receives the pressurized working fluid from the pump and transports the pressurized working fluid therefrom;

a hydraulic turbine disposed at the remote location and coupled to the umbilical such that the hydraulic turbine receives the pressurized working fluid from the umbilical, the hydraulic turbine comprising:

a bypass flow port fluidly communicating with the umbilical;

a turbine flow passage fluidly communicating with the umbilical;

a plurality of turbine blades fluidly communicating with turbine flow passage and configured to rotate a shaft operatively coupled to the one or more shaft energy conversion devices; and a bypass control valve disposed between the umbilical and the turbine flow passage and between the umbilical and the bypass flow port, the bypass control valve configured to selectively direct the fluid to the turbine flow passage and to the bypass flow port; and one or more shaft energy conversion devices operatively coupled to the hydraulic turbine and disposed at the remote location, the one or more shaft energy conversion devices comprising a centrifugal compressor configured to compress the process fluid.

2. The apparatus of claim 1, wherein the umbilical is a pipe.

3. The apparatus of claim 1, further comprising a gas turbine operatively coupled to the pump and configured to drive the pump.

4. The apparatus of claim 3, wherein the first location is on land, on a ship or boat, or on an oil platform, and the remote location is proximal a floor or bottom of the body of water.

5. The apparatus of claim 4, wherein the one or more shaft energy conversion devices further includes a rotary separator coupled to the centrifugal compressor, the rotary separator configured to separate a high-density component of the process fluid from a low-density component of the process fluid, prior to the process fluid being compressed by the centrifugal compressor.

6. The apparatus of claim 1, wherein the pump fluidly communicates with a body of water such that the pressurized working fluid comprises water from the body of water.

7. The apparatus of claim 1, wherein the one or more shaft energy conversion devices include a rotary separator configured to separate a high-density component of the process fluid from a low-density component of the process fluid.

8. The apparatus of claim 1, further comprising a stationary separator disposed upstream of at least one of the one or more shaft energy conversion devices and configured to separate a high-density component of the process fluid from a low-density component of the process fluid.

9. The apparatus of claim 1, wherein the hydraulic turbine discharges the pressurized working fluid into an ambient environment of the remote location.

10. The apparatus of claim 1, wherein:

the pump is configured to provide the working fluid at between about 500 psi and about 5,000 psi and to provide between about 3,000 gpm and about 5,000 gpm of the pressurized working fluid to the umbilical; and the hydraulic turbine is configured to provide between about 500 hp to about 30,000 hp to the one or more shaft energy conversion devices.

11. The apparatus of claim 1 , wherein the bypass control valve comprises a slidable flow control block having a plurality of apertures defined therein, the flow control block being configured to slide between a full-closed position where the flow control block is substantially blocking the turbine flow passage and a full-open position where the turbine flow passage is substantially unobstructed by the flow control block.

12. The apparatus of claim 1, wherein the hydraulic turbine is disposed on a shaft between two journal bearings.

13. The apparatus of claim 1, wherein the hydraulic turbine is overhung on a shaft that is operatively coupled to the one or more shaft energy conversion devices.

14. The apparatus of claim 13, wherein and the hydraulic turbine includes a thrust balancing chamber disposed proximal an end of the shaft, the thrust balancing chamber fluidly communicating with the umbilical to provide a counter-thrust on the shaft.

15. A method for compressing a process fluid at a remote location, comprising:

pressurizing a working fluid at a first location to provide a pressurized working fluid;

transporting the pressurized working fluid to the remote location;

receiving the pressurized working fluid with a hydraulic turbine located at the remote location;

controlling a flow rate of the pressurized working fluid to the hydraulic turbine by actuating a bypass control valve;

powering one or more shaft energy conversion devices with the hydraulic turbine, the one or more shaft energy conversion devices comprising a centrifugal compressor; and compressing the process fluid with the centrifugal compressor.

16. The method of claim 15, further comprising:

powering a rotary separator with the hydraulic turbine; and separating a higher-density component of the process fluid from a lower-density component thereof prior to compressing the process fluid using the centrifugal compressor.

17. The method of claim 15, wherein the remote location is underwater and the first location is on land, on a ship or boat, or on a platform disposed on or above a body of water.

18. The method of claim 15, wherein actuating the bypass control valve comprises sliding a flow control block between a full-open position where at least a majority of the pressurized working fluid is directed through a turbine flow passage and received by blades of the hydraulic turbine, and a full-closed position where at least a majority of the pressurized working fluid is directed through a bypass port.

19. The method of claim 15, further comprising:

overhanging the hydraulic turbine on a shaft operatively coupled to the centrifugal compressor; and balancing axial thrust on the shaft using a balance piston disposed proximal an end of the shaft.

20. A hydraulically-powered compression apparatus, comprising:

a driver including at least one of an electrical motor, an expander, a gas turbine, an diesel engine, a gas engine, and a steam turbine;

a pump operatively coupled to the driver and located on land, on a ship or boat, or on a platform disposed above or floating on the water, the pump having an intake configured receive sea water, and an outlet, wherein the pump is configured to provide pressurized sea water to the outlet;

an umbilical coupled to the outlet of the pump and extending from the pump substantially to a sea floor, wherein the umbilical receives and transports the pressurized sea water from the pump;

a hydraulic turbine located proximal the sea floor and operatively coupled to and overhung on a shaft, the hydraulic turbine including blades coupled to the shaft, an inlet coupled to the umbilical, an outlet communicating with an ambient environment proximal the sea floor, and a bypass control valve including a flow control block that is slidable between a first position in which the flow control block directs substantially all of the pressurized sea water to a bypass flow port and a second position in which the flow control block directs substantially all of the pressurized sea water to the blades; and a compressor operatively coupled to the shaft and located proximal the sea floor, wherein the compressor compresses a process fluid.

21. The hydraulically-powered compression apparatus of claim 20, further comprising a rotary separator operatively coupled to the shaft, wherein the rotary separator removes a substantially liquid component from the process fluid prior to the compressor compressing the process fluid.

* * * * *